US009740130B2

(12) United States Patent
Fukushima et al.

(10) Patent No.: US 9,740,130 B2
(45) Date of Patent: Aug. 22, 2017

(54) ELECTROSTATIC CHARGE IMAGE DEVELOPING CARRIER, ELECTROSTATIC CHARGE IMAGE DEVELOPER, AND DEVELOPER CARTRIDGE

(71) Applicant: FUJI XEROX CO., LTD., Tokyo (JP)

(72) Inventors: Norihito Fukushima, Kanagawa (JP); Takeshi Tanabe, Kanagawa (JP); Toshiaki Hasegawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/840,921

(22) Filed: Aug. 31, 2015

(65) Prior Publication Data

US 2016/0238960 A1 Aug. 18, 2016

(30) Foreign Application Priority Data

Feb. 18, 2015 (JP) ..... 2015-029964

(51) Int. Cl.
*G03G 9/093* (2006.01)
*G03G 9/113* (2006.01)

(52) U.S. Cl.
CPC ..... *G03G 9/1133* (2013.01)

(58) Field of Classification Search
CPC ..... G03G 9/10; G03G 9/1133; G03G 9/1138
See application file for complete search history.

(56) References Cited

U.S. PATENT DOCUMENTS

| | | | | |
|---|---|---|---|---|
| 5,376,488 | A | 12/1994 | Ohmura et al. | |
| 5,631,116 | A | 5/1997 | Uchida et al. | |
| 6,372,400 | B1 | 4/2002 | Yoshizaki et al. | |
| 2004/0058261 | A1* | 3/2004 | Fujii | G03G 5/0517 430/108.4 |
| 2006/0246369 | A1* | 11/2006 | Pattison | G03G 9/1075 430/111.35 |
| 2011/0236815 | A1* | 9/2011 | Veregin | G03G 9/10 430/108.4 |

FOREIGN PATENT DOCUMENTS

| | | | |
|---|---|---|---|
| JP | H06-43697 | A | 2/1994 |
| JP | H06-43698 | A | 2/1994 |
| JP | H07-114219 | A | 5/1995 |
| JP | 2008-304711 | A | 12/2008 |
| JP | 2009-169443 | A | 7/2009 |

* cited by examiner

*Primary Examiner* — Peter Vajda
(74) *Attorney, Agent, or Firm* — Oliff PLC

(57) ABSTRACT

An electrostatic charge image developing carrier includes a core particle and a resin coating layer coated on the core particle, wherein the resin coating layer contains a cationic surfactant and an anionic surfactant and a total content of the cationic surfactant and the anionic surfactant in the resin coating layer is from 0.1% by weight to 6.0% by weight with respect to the entire resin coating layer.

10 Claims, No Drawings

ELECTROSTATIC CHARGE IMAGE DEVELOPING CARRIER, ELECTROSTATIC CHARGE IMAGE DEVELOPER, AND DEVELOPER CARTRIDGE

CROSS-REFERENCE TO RELATED APPLICATIONS

This application is based on and claims priority under 35 USC 119 from Japanese Patent Application No. 2015-029964 filed Feb. 18, 2015.

BACKGROUND

1. Technical Field

The present invention relates to an electrostatic charge image developing carrier, an electrostatic charge image developer, and a developer cartridge.

2. Related Art

A method of visualizing image information through an electrostatic latent image, such as electrophotography, is currently widely used in various fields. In electrophotography, an electrostatic latent image formed on a surface of a photoreceptor (image holding member) through a charging process and an exposure process is developed using a developer containing a toner and the electrostatic latent image is visualized through a transfer process and a fixing process.

Examples of the developer include a two-component developer formed of a toner and a carrier and a single-component developer such as magnetic toner in which a toner is singly used. Among these, since a carrier shares functions of stirring, transportation, charging, and the like of a developer and the functions as the developer are separated, the two-component developer has characteristics of excellent controllability and is currently widely used.

SUMMARY

According to an aspect of the invention, there is provided an electrostatic charge image developing carrier including:

a core particle; and a resin coating layer coated on the core particle, wherein the resin coating layer contains a cationic surfactant and an anionic surfactant, and a total content of the cationic surfactant and the anionic surfactant in the resin coating layer is from 0.1% by weight to 6.0% by weight with respect to the entire resin coating layer.

DETAILED DESCRIPTION

Hereinafter, the exemplary embodiment will be described in detail. In the exemplary embodiment, the expression "from A to B" indicates a range including both A and B, not only a range between A and B. In the following description, expressions "% by weight" and "part by weight" have the same meanings as "% by weight" and "part by weight". In addition, in the following description, a combination of preferable embodiments is a more preferable embodiment.

Electrostatic Charge Image Developing Carrier

An electrostatic charge image developing carrier of the exemplary embodiment (hereinafter, also simply referred to as a "carrier") includes core particles and a resin coating layer coated on the core particles, in which the resin coating layer contains a cationic surfactant and an anionic surfactant, and the total content of the cationic surfactant and the anionic surfactant of the resin coating layer is 0.1% by weight to 6.0% by weight with respect to the entire resin coating layer.

In order to provide a stable image in which environmental effect is prevented, a developer which generates stable charging in which environmental effect is prevented is required. Particularly, the carrier is rarely replaced from the developing device, and accordingly, there is a need for stable reliability with which the carrier be hardly affected by the environment for a long period.

As a result of investigations of the inventors, it is found that a stable image in which environmental effect is prevented is provided by containing the cationic surfactant and the anionic surfactant in the resin coating layer of the electrostatic charge image developing carrier, which leads to completion of the exemplary embodiment.

The specific mechanism of action is not clear, but is assumed as follows.

In general, in a relationship of a charge imparting ability and the environmental effect in a charging design with a resin composition, the higher the charge imparting ability and the charging state, the more it is difficult to be affected by an environmental effect from the high level of the charge imparting ability, and the lower the charge imparting ability and the charging state, the more it is easy to be affected by an environmental effect. The high charging state is preferable in order to suitably maintain the environmental effect, but in this case, it is difficult to perform a developing and transferring process and a stable image in which environmental effect is prevented is not obtained. In the low charging state, an electrostatic controlling property is poor, so-called fogging may be formed, and a stable image in which environmental effect is prevented is not obtained, in the same manner as described above. Accordingly, in order to obtain a stable image in which environmental effect is prevented, the control of the charge imparting ability for each resin type is necessary for the control of the charging level, and accordingly, it is easy to be affected by the environmental effect.

Meanwhile, in the charging control using a surfactant, the anionic surfactant and the cationic surfactant may impart charging according to a polarity. These have a polar functional group and therefore have a high charging imparting ability, and if an added amount which is regulated in the exemplary embodiment is used, it is hardly affected by the environmental effect from the high level of the charging imparting ability. Since the charging imparting abilities thereof are offset by using both types having different polarities in combination, it is possible to control the charging level by controlling the ratio of the combination. At that time, it is assumed that the charging imparting ability of the surfactant which is not offset is not affected by the effect due to the combination use, and the charging level may be controlled while not receiving the environmental effect due to the high charging imparting ability thereof.

There is, as a difference of effects between a method of controlling the charging with the amount of the surfactant added having one polarity and a controlling method using a combination of surfactants having different polarities, and the configuration of the exemplary embodiment with the combination of surfactants having different polarities is preferable, since it is hardly affected by the environmental effect. It is assumed that this is because, salt formed by the combination of surfactants having different polarities promotes appropriate improvement of a charge exchanging property and this has a synergy with the effect of the high charging imparting ability with the surfactant which is not offset.

From such reasons, it is assumed that the environmental effect is prevented and the charging level is controlled by using the cationic surfactant and the anionic surfactant in combination, and it is considered that a stable image may be provided by preventing the effect due to the environment.

Core Particles

The electrostatic charge image developing carrier of the exemplary embodiment includes core particles and a resin coating layer coated on the core particles. The core particles are preferably magnetic particles.

As the core particles, well-known materials may be used. Examples thereof include magnetic metals such as iron, nickel, and cobalt, an alloy of these magnetic metals and manganese, chrome, and a rare earth element, magnetic oxides such as iron oxide, ferrite, and magnetite, and resin dispersion cores in which a conductive material is dispersed in a matrix resin.

Examples of the resin used in the resin dispersion cores include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin, but are not limited thereto.

A volume average particle diameter of the core particles is preferably from 10 μm to 100 μm and more preferably from 20 μm to 50 μm. When the volume average particle diameter of the core particles is equal to or greater than 10 μm, a suitable adhesiveness between the toner and the carrier is obtained and a development amount of the toner is sufficiently obtained. Meanwhile, when the volume average particle diameter thereof is equal to or smaller than 100 μm, a magnetic brush does not become rough, and accordingly, an image having excellent fine-line reproducibility is formed.

The volume average particle diameter d of the core particles may be measured using a laser diffraction/diffusion-type particle size distribution measuring device (LS particle size analyzer: LS13 320 manufactured by Beckman Coulter, Inc). A cumulative distribution by volume is drawn from the side of the smallest diameter with respect to particle size ranges (channels) separated using the particle size distribution obtained, and a particle diameter when the cumulative percentage becomes 50% is set as a volume average particle diameter d.

Regarding a magnetic force of the core particles, saturated magnetization in a magnetic field of 1,000 Oersteds is preferably from 50 emu/g to 100 emu/g and more preferably from 60 emu/g to 100 emu/g. When the saturated magnetization is from 50 emu/g to 100 emu/g, suitable hardness of the magnetic brush is maintained, and accordingly, the fine-line reproducibility is improved and it is possible to prevent the carrier to be developed on the photoreceptor with the toner.

A device which may measure the magnetic properties is not particularly limited, but a vibration sample type magnetism-measuring device VSMP 10-15 (manufactured by Toei Industry Co., Ltd.) is preferably used.

For example, measurement samples are put in a cell having a inner diameter of 7 mm and a height of 5 mm and is set in the device. The measurement is performed by increasing the applied magnetic field, and sweeping is performed to the maximum of 1,000 Oersteds. Next, the applied magnetic field is decreased, and a hysteresis curve is created on a recording sheet. The saturated magnetization, residual magnetization, and a retentive force may be determined from the data of the curve. In the exemplary embodiment, the saturated magnetization indicates magnetization measured in a magnetic field of 1,000 Oersteds.

A volume electric resistance (volume resistivity) of the core particles is preferably in a range of $10^5$ Ω·cm to $10^{9.5}$ Ω·cm and more preferably in a range of $10^7$ Ω·cm to $10^9$ Ω·cm. When the volume electric resistance thereof is equal to or greater than $10^5$ Ω·cm, when toner concentration in the developer is decreased due to repeated copying, the injection of charges to the carrier does not occur, and it is possible to prevent that the carrier is developed. Meanwhile, when the volume electric resistance thereof is equal to or smaller than $10^{9.5}$ Ω·cm, it is possible to prevent a sharp edge effect or pseudo contours and excellent image quality is obtained.

In the exemplary embodiment, the volume electric resistance (Ω·cm) of the cores is measured as follows. In the measurement environment, a temperature is set to 20° C. and humidity is set to 50% RH.

Measurement targets are evenly placed on a surface of a circular jig with the 20 $cm^2$ electrode plate arranged therein, so as to have a thickness of 1 mm to 3 mm, and a layer is formed. The 20 $cm^2$ electrode plate is placed thereon to interpose the layer. In order to eliminate gaps between the measurement targets, a load of 4 kg is applied onto the electrode plate disposed on the layer, and the thickness (cm) of the layer is measured. Both electrodes in the upper portion and the lower portion of the layer are connected to an electrometer and a high-voltage power generation device. A high voltage is applied to both electrodes so as to set an electric field to $10^{3.8}$ V/cm, and a value (A) of current flowing at that time is read, and accordingly, the volume electric resistance (Ω·cm) of the measurement target is calculated. A calculation equation of the volume electric resistance (Ω·cm) of the measurement target is the following equation.

$$R=E\times 20/(I-I_0)/L \qquad \text{Equation:}$$

In the equation, R represents a volume electric resistance (Ω·cm) of the measurement target, E represents an applied voltage (V), I represents a current value (A), $I_0$ represents a current value (A) of the applied voltage 0 V, and L represents a thickness (cm) of a layer, respectively. A coefficient of 20 represents an area ($cm^2$) of the electrode plate.

Resin Coating Layer

The electrostatic charge image developing carrier of the exemplary embodiment includes core particles and a resin coating layer coated on the core particles, and the resin coating layer contains a cationic surfactant and an anionic surfactant. The surfactant is a material showing remarkable surface activity (property of dissolving in water and decreasing surface tension of water) with a small amount and is a compound having a hydrophilic group and a lipophilic group (hydrophobic group). Among these, a material which is ionized in an aqueous solution to provide a cation as a main substance of an activator is a cationic surfactant and a material which is ionized in an aqueous solution to provide an anion as a main substance of an activator is an anionic surfactant.

Examples of cationic surfactant include amine salt type and quaternary ammonium salt type. Specific examples thereof include amine acetic acids such as stearylamine acetate, octadecylamine acetate, tetradecylamine acetate, methylammonium hydrochloride salts such as lauryl trimethyl ammonium chloride, dilauryl dimethyl ammonium chloride, tallow trimethyl ammonium chloride, cetyl trimethyl ammonium chloride, stearyl trimethyl ammonium chloride, behenyltrimethylammonium chloride, distearyl dimethyl ammonium chloride, didecyl dimethyl ammonium chloride, and dioleyl dimethyl ammonium chloride, and benzyl chlorides such as octadecyl dimethyl benzyl ammonium chloride, and tetradecyl dimethyl benzyl ammonium chloride.

Among these, as the cationic surfactant, quaternary ammonium salt type is preferable, and specifically, stearyl trimethyl ammonium chloride and behenyltrimethylammonium chloride are preferable.

As the cationic surfactant, commercially available various products may be used, and for example, SANISOL series, KOTAMIN series, and ACETAMIN series (all manufactured by Kao Corporation) are exemplified. In addition, commercially available various cationic surfactants manufactured by Tokyo Chemical Industry Co., Ltd., Wako Pure Chemical Industries, Ltd. and Junsei Chemical Co., Ltd. are exemplified.

As the anionic surfactant, a material having a structure of carboxylic acid, sulfonic acid, sulfuric acid, and phosphoric acid as a hydrophilic group is preferable.

Specific examples thereof include metal soaps such as sodium laurate, potassium laurate, sodium stearate, lithium stearate, magnesium stearate, calcium stearate, barium stearate, zinc stearate, calcium ricinoleate, barium ricinoleate, zinc ricinoleate, sodium octylate, and zinc octylate, alkyl sulfate esters such as sodium lauryl sulfate, potassium lauryl sulfate, sodium myristyl sulfate, and sodium cetyl sulfate, sulfonic acids such as sodium linear alkylbenzenesulfonate (for example, sodium toluene sulfonate, sodium cumene sulfonate, sodium octyl benzene sulfonate, and sodium dodecyl benzene sulfonate), sodium naphthalene sulfonate, and sodium dibutyl sulfonate, and phosphoric acid esters such as lauryl phosphate, sodium lauryl phosphate, and potassium lauryl phosphate.

Among these, as the anionic surfactant, a material having a sulfonic acid structure is preferable, and specifically, sulfonates such as sodium dodecyl benzene sulfonate and sodium toluene sulfonate are preferably exemplified.

As the anionic surfactant, commercially available various products may be used, and for example, EMAL series, LATEMUL series, LEVENOL series, NEOPEC series, and PELEX series (all manufactured by Kao Corporation), and DOWFAX series (manufactured by The Dow Chemical Company) are exemplified. In addition, commercially available various anionic surfactants manufactured by Tokyo Chemical Industry Co., Ltd., Wako Pure Chemical Industries, Ltd. and Junsei Chemical Co., Ltd. are exemplified.

Content of the cationic surfactant in the resin coating layer is preferably from 0.005% by weight to 4.2% by weight with respect to the entire resin coating layer. It is preferable that the content of the cationic surfactant is in the range described above, because the charging failure is prevented and it is easy to contain a desired amount of the cationic surfactant into the resin coating layer. The content of the cationic surfactant is more preferably from 0.01% by weight to 2.8% by weight, even more preferably from 0.02% by weight to 1.4% by weight, and particularly preferably from 0.02% by weight to 0.7% by weight with respect to the entire resin coating layer.

Content of the anionic surfactant in the resin coating layer is preferably from 0.095% by weight to 5.7% by weight with respect to the entire resin coating layer. It is preferable that the content of the anionic surfactant is in the range described above, because the charging failure is prevented and it is easy to contain a desired amount of the anionic surfactant into the resin coating layer. The content of the anionic surfactant is more preferably from 0.06% by weight to 3.8% by weight, even more preferably from 0.09% by weight to 1.9% by weight, and particularly preferably from 0.12% by weight to 0.95% by weight with respect to the entire resin coating layer.

The total content of the cationic surfactant and the anionic surfactant in the resin coating layer, that is, the total content of the cationic surfactant and the anionic surfactant is from 0.1% by weight to 6.0% by weight with respect to the entire resin coating layer. When the total content of the cationic surfactant and the anionic surfactant in the resin coating layer is in the range described above, the charging failure is prevented and it is easy to contain a desired amount of the surfactant into the resin coating layer. The total content of the cationic surfactant and the anionic surfactant is preferably from 0.2% by weight to 4.0% by weight, more preferably from 0.3% by weight to 2.0% by weight, even more preferably from 0.4% by weight to 1.0% by weight with respect to the entire resin coating layer.

In the exemplary embodiment, the content of the anionic surfactant with respect to the total content of the cationic surfactant and the anionic surfactant contained in the resin coating layer is preferably from 30% by weight to 95% by weight. It is preferable that the content of the anionic surfactant is in the range described above, because the environmental dependency is more prevented.

The content of the anionic surfactant in the cationic surfactant and the anionic surfactant contained in the resin coating layer is more preferably from 50% by weight to 80% by weight and even more preferably from 55% by weight to 70% by weight.

As the surfactant, an amphoteric surfactant or a nonionic surfactant may be contained in the resin coating layer, but herein, the total content of the cationic surfactant and the anionic surfactant in the entirety of surfactants is preferably equal to or greater than 50% by weight, more preferably equal to or greater than 70% by weight, and even more preferably equal to or greater than 90% by weight, and it is particularly preferable to contain only the cationic surfactant and the anionic surfactant.

When the material composition is well known, quality and quantity of the surfactants in the carrier are determined by a method using a high-speed liquid chromatography apparatus (LC6A type manufactured by Shimadzu Corporation). Specifically, the resin coating layer of the carrier is dissolved in a soluble solution, for example, solution such as toluene, and peaks of the coating resin and the surfactant are respectively measured. Meanwhile, only the peak of the coating resin and only the peak of the surfactant are measured in the high-speed liquid chromatography apparatus and calibration curves of each of the coating resin amount and the surfactant amount are created. The measurement regarding the carrier is performed based on the calibration curves and the quality and quantity thereof is determined by the ratio of the peaks.

When the composition of the surfactants is not well known, the unknown surfactants isolated by the high-speed liquid chromatography apparatus are collected, composition determination is performed from chemical device analysis, for example, structure analysis by NMR or IR analysis, and the quantity of each component may be measured through creation of calibration curves. In addition, the quality and quantity may be measured using a liquid chromatography-tandem mass spectrometry. The method is not limited to the methods described above, as long as the quality and quantity may be measured, and other analysis methods may be used.

Examples of resin used in the resin coating layer include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin, but are not limited thereto.

Among these, as the resin used in the resin coating layer, a homopolymer or a copolymer of cycloalkyl methacrylate is preferable, and a homopolymer or a copolymer of cyclohexyl methacrylate is more preferable from a viewpoint of controlling charging amount.

As the resin used in the resin coating layer, a homopolymer or a copolymer of the monomer represented in the following formula (2), that is, a polymer having at least a monomer unit represented in the following formula (3) is preferable.

(2)

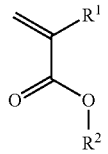

(3)

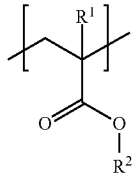

(In the formula (2) and the formula (3), $R^1$ represents a hydrogen atom or a methyl group and $R^2$ represents a cycloalkyl group.)

$R^1$ in the formula (2) and the formula (3) is preferably a methyl group, from a viewpoint of controlling of the charging amount.

$R^2$ in the formula (2) and the formula (3) is preferably a cycloalkyl group having a 5- to 7-membered ring and more preferably a cyclohexyl group, from a viewpoint of controlling of the charging amount. The cycloalkyl group may include or may not include an alkyl group in the ring structure.

A conductive material may be used in the resin coating layer. Specific examples thereof include metal such as gold, silver, or copper, or carbon black, and further include titanium oxide, zinc oxide, barium sulfate, aluminum borate, potassium titanate, and tin oxide, but are not limited thereto. Among these, a white conductive material such as zinc oxide or titanium oxide is preferable as the conductive material. By using the white conductive material, color development in a toner image is hardly affected, when a carrier piece is transferred to a transfer medium.

The resin coating layer may contain a charge-controlling agent. Regarding the charge-controlling agent, the dispersion state is easily controlled and adhesiveness to the surface of the coating resin is excellent, and accordingly, it is possible to prevent separation of the charge-controlling agent from the resin coating layer. The charge-controlling agent functions as a dispersion assistant of conductive powder, the dispersion state of conductive powder in the resin coating layer becomes even, and the change in resistance of carrier may be prevented, even when the coating layer is slightly peeled off.

As the charge-controlling agent, any well-known material, for example, Nigrosine dye, benzimidazole compound, quaternary ammonium salt compounds, alkoxylated amines, alkylamides, molybdic acid chelate pigments, triphenylmethane compounds, salicylic acid metal salt complexes, azo chromium complex, and copper phthalocyanine may be used. Among these, quaternary ammonium salt compounds, alkoxylated amines, and alkylamides are preferably used.

The amount of the charge-controlling agent added is preferably from 0.001 parts by weight to 5 parts by weight and more preferably from 0.01 parts by weight to 0.5 parts by weight, when the amount of core is set as 100 parts by weight. When the amount thereof is in the range described above, a carrier in which sufficient strength of the resin coating layer is sufficient and alteration hardly occurs due to stress in use, and excellent dispersibility of the conductive material is obtained.

A method of forming the resin coating layer on the surface of the core of the carrier is not particularly limited, and a method (wet method) of performing coating with a resin coating layer forming solution obtained by dissolving or dispersing the resin for forming a coating layer and, if necessary, various additives such as a charge-controlling agent in a suitable solvent is exemplified. In addition, a powder coating method (dry method) of performing coating by heating or performing rapid mixing of the coating resin particles and the core particles is exemplified. In the exemplary embodiment, the carrier is preferably prepared by the powder coating method.

The solvent used in the wet method is not particularly limited and may be selected in consideration of the resin to be used, coating suitability, and the like.

In the wet method, specific examples of a method of forming the resin coating layer include a dipping method of dipping core particles of a carrier in a resin coating layer forming solution, a spraying method of spraying a resin coating layer forming solution to surfaces of core particles of a carrier, a fluidized bed method of spraying a resin coating layer forming solution in a state in which core particles of a carrier are allowed to float by flowing air, and a kneader-coater method in which core particles of a carrier and a resin coating layer forming solution are mixed with each other in a kneader-coater and the solvent is removed.

Hereinafter, the powder coating method will be described.

The powder coating method preferably includes a coating step of coating the surfaces of the core particles with a resin composition including a coating resin, and a heating step of performing heating process of the core particles coated with the resin composition.

In the coating step, it is preferable that the core particles and the resin particles are mixed and a resin particle attachment layer is formed on the surfaces of the core particles. The resin particles are resin particles containing at least a coating resin and may contain other components.

The resin composition may contain at least the coating resin and may contain or may not contain other components. For example, other components such as the charge-controlling agent may be added to the resin particles in advance, or may be added with the resin particles and attached to the core particles, in the coating step.

As a device of mixing the core particles and the resin particles, a well-known powder mixing device may be used, and the device may be a batch type or a continuous type. As the batch type, a mixing device with a stirrer such as a HENSCHEL mixer or a NAUTA MIXER is preferably exemplified. In a case of the continuous type, a uniaxial or biaxial paddle mixer, a ribbon mixer, or an extruding mixer is exemplified.

A mixing temperature at the time of mixing is preferably equal to or lower than the glass transition temperature of the resin particles, more preferably a temperature which is at least 10° C. lower than the glass transition temperature of the resin particles, and even more preferably a temperature which is at least 20° C. lower than the glass transition temperature of the resin particles.

In the heating process step, the core particles coated with the resin composition are heated, the resin composition is heated and melted, and a resin coating layer is formed. Herein, a heating temperature is preferably higher than the glass transition temperature of the resin particles used and is more preferably from 150° C. to 250° C. When the heating temperature is in the range described above, the resin may be easily melted and pyrolysis of the resin is prevented.

In the heating process step, the core particles coated with the resin composition are preferably heated while stirring and mixing, in order to crack the adhesion between the particles and to prevent generation of coarse aggregates, and the core particles is more preferably heated while stirring and mixing with the continuous type, from the viewpoint of productivity. As a device used in the heating process step, a paddle mixer, a screw mixer, a turbulizer, a continuous kneader, or a twin screw kneading extruder including a heating unit is exemplified, but there is no limitation thereto.

Other well-known steps may be included, in addition to the coating step and the heating process step. Specific examples thereof include a classification step of classifying the core particles including the resin coating layer obtained and a sieving step of sieving the core particles including the resin coating layer obtained. A classification unit or a sieve used in the classification step and the sieving step is not particularly limited, and a well-known unit may be used.

In the exemplary embodiment, the method of containing the cationic surfactant and the anionic surfactant in the resin coating layer is not particularly limited, but a method of using resin particles containing the cationic surfactant and resin particles containing the anionic surfactant in the powder coating method and to contain the cationic surfactant and the anionic surfactant in the resin coating layer, is preferably exemplified.

Specifically, a method of synthesizing the resin particles by an emulsion polymerization method using the anionic surfactant or the cationic surfactant as the surfactant, and drying this by a freeze-drying to obtain resin particles is exemplified. In this method, the entire amount of the surfactant at the time of performing the process is contained in the resin particles and it is easy to adjust the amount of the surface active material.

As another method, a method including preparing the resin particles by an emulsion polymerization method using the cationic surfactant or the anionic surfactant adding other surfactant to the resin particles after completing polymerization, drying this to prepare resin particles containing the cationic surfactant and the anionic surfactant, and preparing a carrier by a powder coating method using the resin particles, is exemplified.

In the wet method, the resin particles containing the cationic surfactant and the resin particles containing the anionic surfactant are dissolved or dispersed in a solvent to coat the core particles, and accordingly, a carrier including the resin coating layer containing the cationic surfactant and the anionic surfactant may be prepared. A carrier including a resin coating layer may be prepared by the wet method, using the resin particles containing the cationic surfactant and the anionic surfactant described above, instead of using the resin particles containing the cationic surfactant and the resin particles containing the anionic surfactant. It is possible to obtain the effects of the exemplary embodiment even in the wet method of using a lacquer which is a coating resin solution subjected to a polymerization reaction of monomers in a solvent, without dissolving the fine resin particles in a solvent, or even in a case of preparing a carrier by the wet method by adding a desired surfactant in a lacquer.

An average film thickness of the resin coating layer is preferably from 0.5 μm to 10 μm, more preferably from 1 μm to 5 μm, and even more preferably from 1 μm to 3 μm.

When a true specific gravity of the core particles is set as ρ (dimensionless), a volume average particle diameter of the core particles is set as d (μm), an "average specific weight" of the resin coating layer is set as $\rho_c$, the entire content of the resin coating layer with respect to 100 parts by weight of the core particles is set as $W_c$ (parts by weight), the average film thickness (μm) of the resin coating layer may be determined by the following Equation (A).

$$\text{average film thickness } (\mu m) = \{[\text{amount of coating resin per carrier (containing all additives such as conductive powder)/surface area per carrier}]\}/\text{average specific weight of resin coating layer} = \{[4/3\pi\cdot(d/2)^3\cdot\rho\cdot W_c]/[4\pi\cdot(d/2)^2]\}/\rho_c = (1/6)\cdot(d\cdot\rho\cdot W_c/\rho_c) \quad \text{Equation (A):}$$

The content of the resin coating layer in the carrier of the exemplary embodiment is preferably from 0.1 parts by weight to 20 parts by weight, more preferably from 0.5 parts by weight to 10 parts by weight, and even more preferably from 1 parts by weight to 5 parts by weight with respect to 100 parts by weight of core particles. When the content of the resin coating layer is equal to or greater than 0.1 parts by weight, the amount of the surface exposure of the core particles is slight and it is possible to prevent injection of a development field. When the content of the resin coating layer is equal to or smaller than 20 parts by weight, the amount of resin powder isolated from the resin coating layer is small and it is possible to prevent the resin powder peeled in the developer from an initial stage.

It is preferable that a coverage of the surface of the core particles with the resin coating layer is as close to 100%, it is more preferable that the coverage thereof is equal to or greater than 80%, and it is even more preferable that the coverage thereof is equal to or greater than 85%.

The coverage of the resin coating layer may be determined by XPS measurement. JPS80 manufactured by JEOL, Ltd., for example, is used as an XPS measurement device, the measurement is performed by using a MgKα ray as the X-ray source, and setting an accelerating voltage to 10 kV and an emission current to 20 mV. The measurement is performed regarding an element mainly configuring the resin coating layer (normally, carbon) and an element mainly configuring the core (for example, iron and oxygen when the core is an iron oxide material such as magnetite) (hereinafter, the description is made on the assumption that the core is an iron oxide material). Herein, a C1S spectrum is measured for carbon, a $Fe2p_{3/2}$ spectrum is measured for iron, and an O1s spectrum is measured for oxygen.

The number of elements of carbon, oxygen, and iron ($A_C+A_O+A_{Fe}$) is determined based on the spectrum of each element, an iron amount ratio of the core and the carrier obtained by coating the core with the resin coating layer is determined based on the following Equation (B) using the obtained number ratio of elements of carbon, oxygen, and iron, and the coverage is determined based on the following Equation (C).

$$\text{iron amount ratio (atomic \%)}=A_{Fe}/(A_C+A_O+A_{Fe})\times 100 \quad \text{Equation (B):}$$

$$\text{coverage (\%)}=\{1-(\text{iron amount ratio of carrier})/(\text{iron amount ratio of core})\}\times 100 \quad \text{Equation (C):}$$

In a case of using a material other than the iron oxide material as the core particles, the coverage may be determined by measuring a spectrum of a metal element configuring the core other than the oxygen and performing the same calculation based on Equation (B) and Equation (C).

Characteristics of Carrier

A volume average particle diameter of the carrier is preferably from 10 μm to 100 μm and more preferably from 20 μm to 50 μm. When the volume average particle diameter of the carrier is equal to or greater than 10 μm, the carrier is less contaminated. When the volume average particle diameter of the carrier is equal to or smaller than 100 μm, it is possible to prevent a decrease in fine-line reproducibility.

The volume average particle diameter of the carrier is measured using a laser diffraction/diffusion-type particle size distribution measuring device (LS particle size analyzer: LS13 320 manufactured by Beckman Coulter, Inc.)

The shape factor SF1 of the carrier is preferably from 100 to 145. When the shape factor is in the range described above, suitable hardness of a magnetic brush may be maintained and stirring efficiency of the developer is hardly decreased, and accordingly, it is easy to perform the charging control.

The shape factor SF1 of the carrier means a value determined by the following Equation (D).

$$SF1=100\pi\times(ML)^2/(4\times A) \quad \text{Equation (D):}$$

Herein, ML represents a maximum length of a carrier particle and A represents a projected area of a carrier particle.

Carrier particles sampled on slide glass are observed with an optical microscope, the image thereof is input to an image analyzer (LUZEX III manufactured by Nireco Corporation) through a video camera to perform image analysis, and the maximum length and the projected area of the carrier particle are obtained. The number of samples at this time is equal to or greater than 100 and the shape factor shown in Equation (D) is determined using an average value thereof.

The saturated magnetization of the carrier is preferably from 40 emu/g to 100 emu/g and more preferably from 50 emu/g to 100 emu/g.

As a device which measures the magnetic properties, a vibration sample type magnetism-measuring device VSMP 10-15 (manufactured by Toei Industry Co., Ltd.) is used. For example, a measurement sample is put in a cell having an inner diameter of 7 mm and a height of 5 mm, and then is set in the device. The measurement is performed by adding the applied magnetic field, and sweeping is performed to the maximum of 1,000 Oersteds. Next, the applied magnetic field is decreased, and a hysteresis curve is created on a recording sheet. The saturated magnetization, residual magnetization, and a retentive force may be determined from the data of the curve. In the exemplary embodiment, the saturated magnetization indicates magnetization measured in a magnetic field of 1,000 Oersteds.

A volume electric resistance of the carrier is preferably controlled in a range of $1\times10^7$ Ω·cm to $1\times10^{15}$ Ω·cm, more preferably in a range of $1\times10^8$ Ω·cm to $1\times10^{14}$ Ω·cm, and even more preferably in a range of $1\times10^8$ Ω·cm to $1\times10^{13}$ Ω·cm.

When the volume electric resistance of the carrier is equal to or smaller than $1\times10^{15}$ Ω·cm, high resistance is not obtained, and excellent motion as a development electrode at the time of development is obtained, an edge effect is not generated particularly in a solid image part, and excellent solid reproducibility is obtained. Meanwhile, when the volume electric resistance is equal to or greater than $1\times10^7$ Ω·cm, a suitable resistance is obtained, the charge is hardly injected to the carrier from a developing roll when the toner concentration in the developer is decreased, and a phenomenon of developing the carrier hardly occurs.

The volume electric resistance of the carrier is preferably measured in the same manner as in the case of the volume electric resistance of the core.

Electrostatic Charge Image Developer

The electrostatic charge image developer according to the exemplary embodiment (hereinafter, also simply referred to as a "developer") is a two-component developer containing the electrostatic charge image developing carrier of the exemplary embodiment and an electrostatic charge image developing toner.

The mixing ratio (weight ratio) between the electrostatic charge image developing toner and the carrier of the exemplary embodiment in the developer is preferably in a range of 1:100 to 10:100 and more preferably in a range of 3:100 to 8:100 (toner:carrier).

Electrostatic Charge Image Developing Toner

The electrostatic charge image developing toner used in the exemplary embodiment is not particularly limited, and a well-known toner may be used, but a colored toner including a binder resin and a colorant is preferably used.

The electrostatic charge image developing toner preferably contains a binder resin and a colorant, and more preferably contains a binder resin, a colorant, and a release agent. The electrostatic charge image developing toner is preferably a toner in which an external additive is externally added to a toner base particle (hereinafter, also referred to as a colored particle).

Binder Resin

Hereinafter, a polyester resin will be described as an example of the binder resin used in the exemplary embodiment.

The polyester resin according to the exemplary embodiment is mainly, for example, a polycondensate of polyvalent carboxylic acids and polyols.

Examples of the polyvalent carboxylic acid include aromatic carboxylic acids such as terephthalic acid, isophthalic acid, phthalic anhydride, trimellitic anhydride, pyromellitic acid, or naphthalene dicarboxylic acid; aliphatic carboxylic acids such as maleic anhydride, fumaric acid, succinic acid, alkenyl succinic anhydride, or adipic acid; and alicyclic carboxylic acids such as cyclohexanedicarboxylic acid. The polyvalent carboxylic acids may be used alone or in combination of two or more kinds thereof.

Among polyvalent carboxylic acids, aromatic carboxylic acids are preferably used. In order to ensure excellent fixing property, tri- or higher valent carboxylic acid (trimellitic acid or acid anhydride thereof) may be used in combination with dicarboxylic acid, to have a crosslinked structure or a branched structure.

Examples of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adduct of bisphenol A and propylene oxide adduct of bisphenol A. The polyols may be used alone or in combination of two or more kinds thereof.

Among the polyols, aromatic diols and alicyclic diols are preferably used, and aromatic diols are more preferably used. In order to ensure more excellent fixing property, tri- or higher valent polyol (for example, glycerin, trimethylolpropane, or pentaerythritol) may be used in combination with diol, to have a crosslinked structure or a branched structure.

The glass transition temperature (hereinafter, may be abbreviated as "Tg") of the polyester resin is preferably from 50° C. to 80° C. and more preferably from 50° C. to 70° C. When Tg is equal to or higher than 50° C., an excellent thermal storage property is obtained and an excellent storability of a fixed image is obtained. When Tg is equal to or lower than 80° C., an excellent low temperature fixing property is obtained.

The acid value of the polyester resin is preferably from 5 mgKOH/g to 25 mgKOH/g. When the acid value thereof is equal to or greater than 5 mgKOH/g, affinity of the toner to the paper is good and charging properties are also good. When preparing a toner by an emulsion aggregating method which will be described later, emulsified particle is easily prepared, and it is possible to prevent a remarkable increase in an aggregation speed in an aggregation step or a shape change speed in a coalescence step of the emulsion aggregating method, and accordingly, the particle size or the shape is easily controlled. When the acid value of the polyester resin is equal to or smaller than 25 mgKOH/g, the environmental dependency of the charging is not negatively affected. Since it is possible to prevent a remarkable decrease in an aggregation speed in an aggregation step or a shape change speed in a coalescence step when preparing a toner by the emulsion aggregating method, it is possible to prevent a decrease in productivity.

The acid value of the polyester resin is preferably from 6 mgKOH/g to 23 mgKOH/g.

The weight average molecular weight (Mw) of the polyester resin is obtained by molecular weight measurement by gel permeation chromatography (GPC) of soluble tetrahydrofuran (THF), and is preferably from 5,000 to 1,000,000 and more preferably from 7,000 to 500,000, the number average molecular weight (Mn) thereof is preferably from 2,000 to 100,000, and molecular weight distribution Mw/Mn thereof is preferably from 1.5 to 100 and more preferably from 2 to 60.

In the exemplary embodiment, the electrostatic charge image developing toner preferably contains a crystalline resin and more preferably contains a crystalline polyester resin. Among the crystalline polyester resins, an aromatic crystalline resin generally has a melting point which is higher than a melting point range which will be described later, and accordingly, an aliphatic crystalline polyester resin is preferable.

The crystalline resin has a crystalline structure with interaction between molecular chains. The specific mechanism of action is not clear, but it is considered that in the crystal structure, molecular chains are regularly arranged while affecting interaction and a part to which moisture penetrates or absorbs is removed, and accordingly, it is possible to prevent environmental effect. By setting the toner including this crystalline resin and the carrier of the exemplary embodiment as a developer, it is difficult to be affected by environmental effect and it is possible to provide a stable image.

The content of the crystalline resin containing the crystalline polyester resin of the toner base particle according to the exemplary embodiment is preferably from 2% by weight to 30% by weight and more preferably from 4% by weight to 25% by weight. When the content thereof is equal to or greater than 2% by weight, the viscosity of the amorphous resin is decreased at the time of melting and low temperature fixing property is easily improved. When the content thereof is equal to or smaller than 30% by weight, deterioration in charging properties of the toner caused by the presence of the crystalline resin is prevented, and accordingly, the image durability after the fixation to a recording medium is easily obtained.

The melting point of the crystalline resin containing the crystalline polyester resin is preferably in a range of 50° C. to 90° C., more preferably in a range of 55° C. to 90° C., and even more preferably in a range of 60° C. to 90° C. When the melting point is equal to or higher than 50° C., storage of the toner or storability of a toner image after fixation is excellent. When the melting point is equal to or lower than 90° C., low temperature fixing property is improved.

The "crystalline resin" according to the exemplary embodiment indicates those including a clear endothermic peak, not a step-wise change in endothermic amount in differential scanning calorimetry (hereinafter, may be abbreviated as DSC).

Regarding the crystalline polyester resin, in a case of a polymer obtained by copolymerization of another component with a main chain thereof and when the content of the other component is equal to or smaller than 50% by weight, this copolymer is also referred to as crystalline polyester.

The crystalline polyester resin is synthesized from an acid (dicarboxylic acid) component and an alcohol (diol) component, and in the following description, an "acid-derived configuration component" indicates a configuration part of the polyester resin which is an acid component before synthesis of the polyester resin, and an "alcohol-derived configuration component" indicates a configuration part which is an alcohol component before synthesis of the polyester resin.

Acid-Derived Configuration Component

Various dicarboxylic acids are used as acid to be the acid-derived configuration component, and as the acid-derived configuration component of the crystalline polyester resin according to the exemplary embodiment, straight-chain aliphatic dicarboxylic acid is preferable.

Examples thereof include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecanedicarboxylic acid, 1,18-octadecanedicarboxylic acid, or lower alkylester or anhydride thereof, but are not limited thereto. Among these, adipic acid, sebacic acid, and 1,10-decane dicarboxylic acid are preferable in view of availability.

As the acid-derived configuration component, configuration components such as a dicarboxylic acid-derived configuration component having double bond and a dicarboxylic acid-derived configuration component having a sulfonate group may be additionally contained.

Alcohol-Derived Configuration Component

As alcohol to be the alcohol-derived configuration component, aliphatic diol is preferable, and examples thereof include ethylene glycol, 1,3-propanediol, 1,4-butanediol, 1,5-pentanediol, 1,6-hexanediol, 1,7-heptane diol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol, but are not limited thereto. Among these, 1,4-butanediol, 1,6-hexanediol, 1,8-octanediol, 1,9-nonanediol, and 1,10-decanediol are preferable, in view of availability or cost.

The molecular weight (weight average molecular weight; Mw) of the crystalline polyester resin is preferably from 8,000 to 40,000 and more preferably from 10,000 to 30,000, from the viewpoints of manufacturability of the resin, fine dispersion when preparing the toner, or compatibility when melting. When the weight average molecular weight thereof is equal to or greater than 8,000, a decrease in resistance of the crystalline polyester resin is prevented, and accordingly, a decrease in charging properties is prevented. When the weight average molecular weight thereof is equal to or smaller than 40,000, the cost of the resin synthesis is prevented, a decrease in a sharp melting property is kept down, and accordingly, the low temperature fixing property is not negatively affected.

In the exemplary embodiment, the molecular weight of the polyester resin is measured and calculated by gel permeation chromatography (GPC). Specifically, the measurement of a polyester resin by GPC is performed with a tetrahydrofuran (THF) solvent using HLC-8120 manufactured by Tosoh Corporation by using a column TSKGEL SUPER HM-M (15 cm) manufactured by Tosoh Corporation. Next, the molecular weight of the polyester resin is calculated using a calibration curve of molecular weight created with a monodisperse polystyrene standard sample.

Method of Preparing Polyester Resin

A method of preparing the polyester resin is not particularly limited, and the polyester resin may be prepared by a general polyester polymerization method for causing an acid component to react with an alcohol component. For example, the polyester resin is prepared by using direct polycondensation, an ester exchange method, and the like depending on the types of monomers. A molar ratio (acid component/alcohol component) when causing the acid component to react with the alcohol component is different depending on reaction conditions, and therefore it is not constant, but about 1/1 is generally preferable for obtaining high molecular weight.

Examples of the catalyst which may be used when preparing the polyester resin include an alkaline metal compound such as sodium and lithium; an alkaline earth metal compound such as magnesium and calcium; a metal compound such as zinc, manganese, antimony, titanium, tin, zirconium, and germanium; a phosphorous acid compound; a phosphoric acid compound; and an amine compound.

In addition to the polyester resin, other resins may be used as a binder resin. Examples of the other resins include an ethylene resin such as polyethylene and polypropylene; a styrene resin such as polystyrene and α-polymethylstyrene; a (meth)acrylic resin such as polymethyl methacrylate and polyacrylonitrile; a polyamide resin, a polycarbonate resin, a polyether resin, and a copolymer resin thereof.

The binder resin may be used alone or in combination of two or more kinds thereof.

Among these, as described above, it is preferable to use the amorphous resin and the crystalline resin in combination as the binder resin, and it is more preferable to use the amorphous polyester resin and the crystalline polyester resin in combination.

Colorant

In the exemplary embodiment, the electrostatic charge image developing toner preferably contains a colorant. The colorant may be a dye or a pigment, but a pigment is preferable, from the viewpoint of light fastness or water resistance.

Examples thereof include well-known pigments such as carbon black, aniline black, aniline blue, calco oil blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The content of the colorant in the electrostatic charge image developing toner of the exemplary embodiment is preferably from 1 part by weight to 30 parts by weight with respect to 100 parts by weight of the binder resin.

If necessary, it is also effective to use a surface-treated colorant or use a pigment dispersant. A yellow toner, a magenta toner, a cyan toner, and a black toner are obtained by selecting kinds of the colorants.

Release Agent

In the exemplary embodiment, the electrostatic charge image developing toner may contain a release agent, if necessary. Examples of the release agent include paraffin wax such as low molecular weight polypropylene and low molecular weight polyethylene; a silicone resin; rosins; rice wax; and carnauba wax. The melting point of the release agent is preferably from 50° C. to 100° C. and more preferably from 60° C. to 95° C.

The content of the release agent in the electrostatic charge image developing toner is preferably from 0.5% by weight to 15% by weight and more preferably from 1.0% by weight to 12% by weight. When the content of the release agent is equal to or greater than 0.5% by weight, peeling failure at the time of oilless fixation is particularly prevented. When the content of the release agent is equal to or smaller than 15% by weight, deterioration in fluidity of the toner is prevented, and accordingly, image quality and reliability of image forming are maintained.

Other Additives

In the exemplary embodiment, in addition to the components described above, various components such as an internal additive, a charge-controlling agent, inorganic powder (inorganic particles), and organic particles may be added to the electrostatic charge image developing toner, if necessary.

Examples of the internal additive include metal such as ferrite, magnetite, reduced iron, cobalt, nickel, manganese, alloy, or a magnetic material such as a compound including the metals.

Examples of the charge-controlling agent include a dye formed of a complex such as a quaternary ammonium salt compound, a nigrosine compound, aluminum, iron, and chrome, and a triphenylmethane pigment.

The inorganic particles are added for various purposes, and may be added in order to adjust viscoelasticity of the toner. By adjusting the viscoelasticity, image gloss or a degree of seeping to paper is adjusted. As the inorganic particles, well-known inorganic particles such as silica particles, titanium oxide particles, alumina particles, cerium oxide particles or a material obtained by hydrophobizing treatment of the surface thereof may be used alone or in combination of two or more kinds thereof, and silica particles having a refractive index which is smaller than that of the binder resin is preferably used, in order to maintain color development or transparency such as OHP transparency. The silica particles may be subjected to various surface treatment, and for example, a material subjected to surface treatment with a silane coupling agent, a titanium coupling agent, or a silicone oil is preferably used.

Characteristics of Toner

In the exemplary embodiment, the electrostatic charge image developing toner preferably has a spherical shape having the shape factor SF1 in a range of 115 to 140. The spherical shape of the toner is preferable from the viewpoints of a developing property and a transfer property, but is inferior from a viewpoint of a cleaning property, compared to a case of an irregular shape. By setting the shape of the toner in the range of the shapes described above, transfer efficiency, compactness of an image is improved, a high quality image forming is performed, and a cleaning property of a surface of a photoreceptor is increased.

The shape factor SF1 is more preferably in a range of 120 to 138.

Herein, the shape factor SF1 is determined by the following Equation (1).

$$SF1=(ML^2/A)\times(\pi/4)\times 100 \quad \text{Equation (1)}$$

In Equation (1), ML represents an absolute maximum length of a toner particles and A represents a projected area of a toner particles.

The shape factor SF1, for example, may be calculated as follows mainly using a microscopic image or an image of a scanning electron microscope (SEM) that is analyzed using an image analyzer to be digitalized. That is, an optical microscopic image of particles sprayed on the surface of a glass slide is captured into an image analyzer LUZEX through a video camera, the maximum lengths and the projected areas of 100 particles are obtained for calculation using the above-described Equation (1), and an average value thereof is obtained.

In the exemplary embodiment, the volume average particle diameter of the electrostatic charge image developing toner is preferably from 3 μm to 9 μm, more preferably from 3.5 μm to 8.5 and even more preferably from 4 μm to 8 μm. When the volume average particle diameter thereof is equal to or greater than 3 μm, a decrease in fluidity of the toner is prevented, and accordingly it is easy to maintain charging properties of each particle. In addition, charging distribution is not widened, fogging on a background is prevented, and toner is hardly spilled from the developing device. When the volume average particle diameter of the toner is equal to or greater than 3 μm, the cleaning property is improved. When the volume average particle diameter thereof is equal to or smaller than 9 μm, a decrease in resolution is prevented, and accordingly, sufficient image quality is obtained and recent requirements regarding high image quality are satisfied.

The volume average particle diameter $D_{50}$ is, for example, measured using a measuring device such as a COULTER MULTISIZER II (manufactured by Beckman Coulter, Inc.)

The complex elastic modulus (G*) of the electrostatic charge image developing toner according to the exemplary embodiment at 110° C. is preferably from 10,000 Pa to 100,000 Pa, more preferably from 11,000 Pa to 95,000 Pa, and particularly preferably from 12,000 Pa to 90,000 Pa. When the complex elastic modulus (G*) is equal to or greater than 10,000 Pa, suitable glossiness of an image is obtained. When the complex elastic modulus (G*) is equal to or smaller than 100,000 Pa, an excellent low temperature fixing property is obtained.

The tan δ (G"/G') of the electrostatic charge image developing toner according to the exemplary embodiment at 110° C. is preferably equal to or smaller than 1.6, more preferably equal to or smaller than 1.5, and even more preferably equal to or smaller than 1.4. When the tan δ is equal to or smaller than 1.6, suitable glossiness of an image is obtained. In the exemplary embodiment, G' represents a storage modulus and G" represents a loss modulus.

Method of Preparing Electrostatic Charge Image Developing Toner

A method of preparing the electrostatic charge image developing toner according to the exemplary embodiment is not particularly limited, and the electrostatic charge image developing toner is prepared using a dry method such as a kneading and pulverizing method or a wet method such as a melt and suspension method, an emulsion aggregating method, or a dissolving and suspension method. Among these, the electrostatic charge image developing toner is preferably prepared using the emulsion aggregating method.

The emulsion aggregating method is a method of preparing dispersions (emulsified solution, pigment dispersion, and the like) containing components contained in a toner base particle (binder resin, colorant, and the like) respectively, mixing these dispersions to aggregate the toner base particle components with each other to create aggregated particles, and heating the aggregated particles at a temperature higher than a melting point or a glass transition temperature of the binder resin to cause thermal coalescence of the aggregated particles.

In the emulsion aggregating method, it is easy to prepare the toner base particles (colored particles) having a small particle diameter and it is easy to obtain the uniform toner base particles having narrow particle size distribution, compared to the kneading and pulverizing method which is a dry method or the melt and suspension method or a dissolving and suspension method which are other wet methods. In addition, the shape controlling is easily performed and uniform particles having an even irregular shape are prepared, compared to the melt and suspension method and the dissolving and suspension method. Further, the structure control of the particles such as coating film formation may be performed, and when the release agent or the crystalline polyester resin is contained, surface exposure thereof is prevented, and accordingly deterioration in charging properties or storability is prevented.

Next, preparing steps of the emulsion aggregating method will be described in detail.

The emulsion aggregating method includes at least an emulsification step of emulsifying a raw material configuring a toner base particle to form resin particles (emulsified particles), an aggregating step of forming aggregates of the resin particles, and a coalescence step of coalescing the aggregates. Hereinafter, an example of the preparing steps of the colored particles by the emulsion aggregating method will be described for each step.

Emulsification Step

As a preparing method of the emulsified solution, a phase inversion emulsification method or a melt and emulsification method is exemplified.

In the phase inversion emulsification method, a resin to be dispersed is dissolved in a hydrophobic organic solvent capable of dissolving the resin, and a base is added to the organic continuous phase (oil phase; O) to neutralize the resin. Then, an aqueous medium (water phase; W) is added to invert the resin from water in oil (W/O) to oil in water (O/W), so that the resin in the organic continuous phase is inverted into a discontinuous phase. Accordingly, the resin is dispersed and stabilized in a particulate shape in an aqueous medium and an emulsified solution is prepared.

In the melt and emulsification method, a shear force is applied to a solution obtained by mixing the aqueous medium and the resin with each other by a dispersing device, and accordingly an emulsified solution is prepared. At that time, the viscosity of the resin component is decreased by heating, and accordingly particles are formed. In order to stabilize the dispersed resin particles, a dispersant may be used. When the resin is oily and has comparatively low solubility to water, the resin is dissolved in a solvent capable of dissolving the resin to perform particle dispersion with a dispersant or a polyelectrolyte in water, and the solvent is evaporated by heating or reducing the pressure, and accordingly, an emulsified liquid in which resin particles are dispersed may be prepared.

Examples of the dispersing device used in dispersion of the emulsified liquid by the melt and emulsification method include a homogenizer, a homomixer, a pressure kneader, an extruder, and a media dispersing device.

Examples of the aqueous medium include water such as distilled water and ion exchange water; and alcohols. Water, which is used alone, is preferable.

Examples of the dispersant that is used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; and surfactants such as anionic surfactants, e.g., sodium dodecylbenzenesulfonate, sodium octadecylsulfate, sodium oleate, sodium laurate, and potassium stearate, cationic surfactants, e.g., laurylamine acetate, stearyl amine acetate, and lauryl trimethyl ammonium chloride, zwitterionic surfactants, e.g., lauryl dimethyl amine oxide, and nonionic surfactants, e.g., polyoxyethylene alkyl ether, polyoxyethylene alkyl phenyl ether, and polyoxyethylene alkylamine. Among these, the anionic surfactant is generally used from a viewpoint of ease of cleaning or environmental suitability.

The content of the resin particles contained in the emulsified solution in the emulsification step is preferably in a range of 10% by weight to 50% by weight and more preferably in a range of 20% by weight to 40% by weight. When the content thereof is equal to or greater than 10% by weight, the particle size distribution is not excessively widened. When the content thereof is equal to or smaller than 50% by weight, uniform stirring may be performed and toner base particles having narrow particle size distribution and uniform characteristics are obtained.

Regarding the size of the resin particles, an average particle diameter (volume average particle diameter) thereof is preferably from 0.08 μm to 0.8 μm, more preferably from 0.09 μm to 0.6 μm, and even more preferably from 0.10 μm to 0.5 μm. When the average particle diameter thereof is equal to or greater than 0.08 μm, the resin particles are easily aggregated. When the average particle diameter thereof is equal to or smaller than 0.8 μm, the particle diameter distribution of the toner base particles is hardly widened, precipitation of the emulsified particles is prevented, and accordingly, storability of an emulsified particle dispersion is improved.

Before performing the aggregation step described below, a dispersion in which a colorant or a release agent which is a colored particle component other than the binder resin is dispersed may preferably be prepared.

Without using a method of preparing a dispersion with each component such as the binder resin and the colorant, for example, when preparing an emulsified solution of a certain component, other components are added to a solvent to emulsify two or more components at the same time, and plural components may be contained in the dispersion particles.

Aggregation Step

In the aggregation step, a dispersion of resin particles obtained in the emulsification step and a colorant dispersion are mixed to prepare a mixture, and heated at a temperature that is not higher than the glass transition temperature of the binder resin to aggregate the resin particles, thereby forming aggregated particles. In order to form the aggregated particles, the pH of the mixture is adjusted to acidic under stirring. The pH is preferably in a range of 2 to 7, more preferably in a range of 2.2 to 6, and even more preferably in a range of 2.4 to 5.

When forming the aggregated particles, it is also effective to use an aggregating agent. Preferable examples of the aggregation agent include a surfactant having a polarity opposite to the polarity of the surfactant used as the dispersant, an inorganic metal salt and a divalent or higher-valent metal complex. In particular, when a metal complex is used, the amount of the surfactant used is reduced, which results in improvement of charging properties and therefore it is particularly preferable.

Examples of the inorganic metal salt include metal salts such as calcium chloride, calcium nitrate, barium chloride, magnesium chloride, zinc chloride, aluminum chloride, and aluminum sulfate, and polymers of inorganic metal salts such as polyaluminum chloride, polyaluminum hydroxide and calcium polysulfide. Among these, aluminum salts and polymers thereof are particularly preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In addition, when the aggregated particles have a desired particle diameter, the resin emulsified particles may be further added to prepare colored particles having a configuration in which a surface of a core aggregated particle is coated with a binder resin. In this case, the release agent or the crystalline polyester resin is not easily exposed to the surface of the colored particles, and thus the configuration is preferable from the viewpoint of charging properties or storability. In the case of further addition, an aggregating agent may be added or the pH may be adjusted before further addition.

Coalescence Step

In the coalescence step, the progression of the aggregation is stopped by increasing the pH of the suspension of the aggregated particles to the range of 4 to 8 under stirring conditions based on the aggregation step, and the aggregated particles are coalesced by heating at a temperature that is equal to or higher than the glass transition temperature of the binder resin. NaOH aqueous solution is preferable as an alkaline solution used for increasing pH. Other alkaline solution, for example, an ammonia solution is not preferable in a viewpoint of volatility or safety. Since divalent alkaline solution such as $Ca(OH)_2$ is hardly dissolved in water, the amount added may be increased or aggregation stopping ability may not be sufficient, and therefore it is not preferable.

Regarding the heating time, the heating may be performed to the extent that the coalescence is caused, and may be performed for 0.5 hours to 10 hours. After coalescence of the aggregated particles, cooling is performed to obtain coalesced particles. In addition, in the cooling step, recrystallization of the release agent or the binder resin may be prevented by increasing the cooling rate at around the melting point of the release agent or the binder resin (melting point±10° C.), that is, so-called rapid cooling, and accordingly the surface exposure may be prevented.

Through the above steps, the colored particles are obtained as the coalesced particles.

The coalesced particles obtained by the coalescence are subjected to a solid-liquid separation step such as filtration, and if necessary, a washing step and a drying step, and thus toner particles are obtained.

It is preferable to perform a step of externally adding an external additive to the obtained toner particles.

In addition, if necessary, coarse toner particles may be removed after the external addition using an ultrasonic sieving machine, a vibrating sieving machine, a wind classifier or the like.

The colored particles used in the exemplary embodiment may be prepared by the kneading and pulverizing method which is generally used.

In order to prepare the colored particles by the kneading and pulverizing method, the binder resin, the colorant, and the release agent are melted, kneaded, and dispersed using, for example, a pressure kneader, a roll mill, or an extruder, the resultant material is subjected to fine pulverization using a jet mill after cooling, and classified using a classifier, for example, a wind classifier, to obtain colored particles having a desired particle diameter.

Developer Cartridge, process Cartridge, Image Forming Apparatus, and Image Forming Method Next, a developer cartridge of the exemplary embodiment will be described.

The developer cartridge of the exemplary embodiment is a cartridge which accommodates at least the electrostatic charge image developer of the exemplary embodiment. In addition, the developer cartridge of the exemplary embodiment is preferably detachable from an image forming apparatus.

By using the developer cartridge of the exemplary embodiment accommodating the electrostatic charge image developer of the exemplary embodiment in the image forming apparatus, it is possible to prevent effects due to the environment and to perform stable image forming.

A developer cartridge containing a container that accommodates the developer may be used.

An image forming method of the exemplary embodiment is not particularly limited, as long as it is an image forming method using the carrier of the exemplary embodiment, and the image forming method preferably includes at least a charging step of charging an image holding member; an exposing step of forming an electrostatic latent image on the surface of the image holding member; a developing step of developing the electrostatic latent image formed on the surface of the image holding member using an electrostatic charge image developer to forma toner image; a transfer step of transferring the toner image formed on the surface of the image holding member onto the surface of a transfer medium; and a fixing step of fixing the toner image, and the electrostatic charge image developer is preferably the electrostatic charge image developer of the exemplary embodiment.

As the image forming method of the exemplary embodiment, a method of preparing a developer using the carrier of the exemplary embodiment, forming and developing an electrostatic image by a commonly used electrophotographic copying machine using the developer, and electrostatic transferring the obtained toner image onto a transfer sheet and fixing the toner image using a heating roller fixing device in which a temperature of the heating roller is set to a given temperature after, to form a copied image is used as an example.

The carrier for the electrostatic charge image developer of the exemplary embodiment may be used in the image forming method of a normal electrostatic charge image developing method (electrophotographic method). Specifically, the image forming method of the exemplary embodiment is preferably a method including, for example, an electrostatic latent image forming step, a developing step, and a transfer step, and if necessary, may further include a cleaning step. Each step is a general step, and for example, is disclosed in JP-A-56-40868 and JP-A-49-91231. The image forming method of the exemplary embodiment may be performed using an image forming apparatus such as a well-known copying machine or facsimile machine.

The electrostatic latent image forming step is a step of forming an electrostatic latent image on the image holding member.

The developing step is a step of developing the electrostatic latent image by a developer layer on a developer carrier to form a toner image. The developer layer is not particularly limited, as long as it contains the electrostatic charge image developing toner and the electrostatic charge image developer carrier of the exemplary embodiment (electrostatic charge image developer of the exemplary embodiment).

The transfer step is a step of transferring the toner image on a transfer medium. As a transfer medium in the transfer step, an intermediate transfer member or a recording medium such as paper may be exemplified.

In the fixing step, the toner image transferred to the transfer paper is fixed by a heating roller fixing device in which a heating roller temperature is set as a given temperature and the copied image is formed.

The cleaning step is a step of removing the electrostatic charge image developer remaining on the image holding member.

The image forming method of the exemplary embodiment preferably includes a recycling step. The recycling step is a step of moving the electrostatic charge image developing toner collected in the cleaning step to the developer layer. The image forming method including this recycling step may be performed using an image forming apparatus such as a toner recycling system type copying machine or a facsimile machine. It is possible to apply to a recycling system in which the cleaning step is omitted, and the toner is collected at the same time with the development.

The image forming apparatus of the exemplary embodiment is not particularly limited, as long as it is an image forming apparatus including the carrier of the exemplary embodiment, but it preferably includes an image holding member, a charging unit for charging an image holding member; an exposing unit for exposing the charged image holding member and forming an electrostatic latent image on the image holding member; a developing unit for developing the electrostatic latent image formed using a developer to form a toner image; a transfer unit for transferring the toner image to a transfer medium from the image holding member; and a fixing unit for fixing the toner image, and the electrostatic charge image developer is preferably the electrostatic charge image developer of the exemplary embodiment.

The image forming apparatus of the exemplary embodiment may include a fixing unit, a cleaning unit, or an erasing unit, if necessary, other than the image holding member, the charging unit, the exposing unit, the developing unit, and the transfer unit.

In the transfer unit, the transfer is performed for two or more times using an intermediate transfer member. An intermediate transfer member or a recording medium such as paper is exemplified as the transfer medium in the transfer unit.

In the image holding member and each unit described above, it is possible to preferably use a configuration described for each step of the image forming method. As each unit, a well-known unit in an image forming apparatus may be used. The image forming apparatus of the exemplary embodiment may include units or apparatus having other configuration than the configuration described above. In the image forming apparatus of the exemplary embodiment, plural units among the units described above may be operated at the same time.

EXAMPLES

Hereinafter, the exemplary embodiment will be described in detail using examples, but the exemplary embodiment is not limited only to examples shown below. Unless specifically noted, "parts" in the following description means "parts by weight". A "primary particle diameter" in the following description represents a "primary volume average particle diameter".

Preparation of Carrier

Synthesis of Resin Particles 1

Cyclohexyl methacrylate (manufactured by Wako Pure Chemical Industries, Ltd.): 100 parts Anionic surfactant (NEOGEN SC manufactured by Dai-Ichi Kogyo Seiyaku Co., Ltd., solid content concentration of 10% by weight): 6.1 parts The above materials are mixed with each other while stirring, and 800 parts of ion exchange water is slowly added thereto. After the obtained mixture becomes clouded, heating is performed to 80° C. at 5° C./min while performing nitrogen substitution, and when the temperature reaches 80° C., the mixture is kept while stirring for 15 minutes. An aqueous solution obtained by dissolving 1.0 part of ammonium persulfate (polymerization initiator) in 50 parts of ion exchange water is added for 30 minutes and the obtained mixture is kept for 7 hours after adding.

Then, cooling is performed, freeze-drying is performed for 12 hours, and resin particles for coating (coating resin particles) A1 are obtained.

Synthesis of Resin Particles 2

Resin particles A2 are obtained in the same manner as in the synthesis of resin particles 1, except for changing the amount of the anionic surfactant added to 59.9 parts.

Synthesis of Resin Particles 3

Resin particles A3 are obtained in the same manner as in the synthesis of resin particles 1, except for changing the amount of the anionic surfactant added to 92.6 parts.

Synthesis of Resin Particles 4

Resin particles A4 are obtained in the same manner as in the synthesis of resin particles 1, except for changing the amount of the anionic surfactant added to 4.3 parts.

Synthesis of Resin Particles 5

Resin particles A5 are obtained in the same manner as in the synthesis of resin particles 1, except for changing the amount of the anionic surfactant added to 29.1 parts.

Synthesis of Resin Particles 6

Resin particles A6 are obtained in the same manner as in the synthesis of resin particles 1, except for changing the amount of the anionic surfactant added to 5.7 parts.

Synthesis of Resin Particles 7

Resin particles A7 are obtained in the same manner as in the synthesis of resin particles 1, except for changing the amount of the anionic surfactant added to 14.3 parts.

Synthesis of Resin Particles 8

Resin particles A8 are obtained in the same manner as in the synthesis of resin particles 1, except for changing the amount of the anionic surfactant added to 109.7 parts.

Synthesis of Resin Particles 9

Resin particles A9 are obtained in the same manner as in the synthesis of resin particles 1, except for using DOWFAX (solid content concentration of 10% by weight) manufactured by The Dow Chemical Company instead of NEOGEN SC as the anionic surfactant.

Synthesis of Resin Particles 10

Cyclohexyl methacrylate (manufactured by Wako Pure Chemical Industries, Ltd.): 100 parts Cationic surfactant (stearyl trimethyl ammonium chloride manufactured by Kao Corporation, solid content concentration of 10% by weight): 6.1 parts The above materials are mixed with each other while stirring, and 800 parts of ion exchange water is slowly added thereto. After the obtained mixture becomes clouded, heating is performed to 80° C. at 5° C./min while performing nitrogen substitution, and when the temperature reaches 80° C., the mixture is kept while stirring for 15 minutes. An aqueous solution obtained by dissolving 1.0 part of ammoniumpersulfate (polymerization initiator) in 50 parts of ion exchange water is added for 30 minutes and the obtained mixture is kept for 7 hours after adding.

Then, cooling is performed, freeze-drying is performed for 12 hours, and resin particles for coating C1 are obtained.

Synthesis of Resin Particles 11

Resin particles C2 are obtained in the same manner as in the synthesis of resin particles 10, except for changing the amount of the cationic surfactant added to 24.8 parts.

Synthesis of Resin Particles 12

Resin particles C3 are obtained in the same manner as in the synthesis of resin particles 10, except for changing the amount of the cationic surfactant added to 37.7 parts.

Synthesis of Resin Particles 13

Resin particles C4 are obtained in the same manner as in the synthesis of resin particles 10, except for changing the amount of the cationic surfactant added to 1.8 parts.

Synthesis of Resin Particles 14

Resin particles C5 are obtained in the same manner as in the synthesis of resin particles 10, except for changing the amount of the cationic surfactant added to 12.3 parts.

Synthesis of Resin Particles 15

Resin particles C6 are obtained in the same manner as in the synthesis of resin particles 10, except for changing the amount of the cationic surfactant added to 2.4 parts.

Synthesis of Resin Particles 16

Resin particles C7 are obtained in the same manner as in the synthesis of resin particles 10, except for changing the amount of the cationic surfactant added to 6.1 parts.

Synthesis of Resin Particles 17

Resin particles C8 are obtained in the same manner as in the synthesis of resin particles 10, except for changing the amount of the cationic surfactant added to 44.3 parts.

Synthesis of Resin Particles 18

Resin particles C9 are obtained in the same manner as in the synthesis of resin particles 10, except for using SANISOL (alkyl benzyl dimethyl ammonium chloride manufactured by Kao Corporation, solid content concentration of 10% by weight) instead of stearyl trimethyl ammonium chloride as the cationic surfactant added.

Synthesis of Resin Particles 19

After heating is performed to cause a reaction for 7 hours as in the synthesis of resin particles 4, the resultant material is cooled to a room temperature. Then, 1.8 parts of the cationic surfactant used in the synthesis of resin particles 9 is added after diluting with 100 parts of ion exchange water and stirred for 30 minutes. After that, freeze-drying is performed for 12 hours, and resin particles for coating CA1 are obtained.

Synthesis of Resin Solution 1

100 parts by weight of cyclohexyl methacrylate, 150 parts by weight of toluene, and 2 parts by weight of azobisisobutyronitrile are mixed with each other, heated to 60° C. after nitrogen gas substitution, vibrated for 8 hours, to perform a polymerization reaction. After that, 1.4 parts of the anionic surfactant (NEOGEN SC manufactured by Dai-Ichi Kogyo Seiyaku Co., Ltd., solid content concentration of 10% by weight) is added to a polymerization solution obtained after cooling to a room temperature, and a resin solution a1 is obtained.

Synthesis of Resin Solution 2

A resin solution a2 is obtained in the same manner as in the synthesis of resin solution a1, except for adding 0.7 parts of the anionic surfactant to the obtained polymerization solution.

Synthesis of Resin Solution 3

A resin solution c1 is obtained in the same manner as in the synthesis of resin solution a1, except for adding 0.6 parts of the cationic surfactant (stearyl trimethyl ammonium chloride manufactured by Kao Corporation, solid content concentration of 10% by weight) to the obtained polymerization solution.

Synthesis of Resin Solution 4

A resin solution c2 is obtained in the same manner as in the synthesis of resin solution a1, except for adding 0.3 parts of the cationic surfactant (stearyl trimethyl ammonium chloride manufactured by Kao Corporation, solid content concentration of 10% by weight) to the obtained polymerization solution.

Preparation of Carrier 1

1.6 parts of the resin particles C1, 30.6 parts of the resin particles A1, and 2.8 parts of conductive particles (carbon black, REGAL 330 manufactured by Cabot Corporation) are mixed for 10 minutes using a HENSCHEL mixer (HENSCHEL MIXER manufactured by NIPPON COKE & ENGINEERING. CO., LTD.). Then, 1,000 parts of core particles (EF-35B manufactured by Powdertech Co., Ltd.) is added thereto, the mixed powder is heated to 220° C. using an extruder (TEM manufactured by Toshiba Machine Co., Ltd.), to perform filming treatment and a coating resin layer is formed. Then, a cracking process and a sieving process are performed and a carrier 1 having a volume average particle diameter of 36.2 μm is obtained.

Preparation of Carrier 2

A carrier 2 is obtained in the same manner as in the carrier 1, except for changing the amount of the resin particles C1 to 3.2 parts and changing the amount of the resin particles A1 to 29.0 parts.

Preparation of Carrier 3

A carrier 3 is obtained in the same manner as in the carrier 1, except for changing the amount of the resin particles C1 to 6.4 parts and changing the amount of the resin particles A1 to 25.8 parts.

Preparation of Carrier 4

A carrier 4 is obtained in the same manner as in the carrier 1, except for changing the amount of the resin particles C1 to 9.7 parts and changing the amount of the resin particles A1 to 22.5 parts.

Preparation of Carrier 5

A carrier 5 is obtained in the same manner as in the carrier 1, except for changing the amount of the resin particles C1 to 16.1 parts and changing the amount of the resin particles A1 to 16.1 parts.

Preparation of Carrier 6

A carrier 6 is obtained in the same manner as in the carrier 1, except for changing the amount of the resin particles C1 to 19.3 parts and changing the amount of the resin particles A1 to 12.9 parts.

Preparation of Carrier 7

A carrier 7 is obtained in the same manner as in the carrier 1, except for changing the amount of the resin particles C1 to 22.5 parts and changing the amount of the resin particles A1 to 9.7 parts.

Preparation of Carrier 8

39.8 parts of the resin solution c1 and 39.9 parts of the resin solution a1 are added to, stirred, and dissolved in 134.2 parts of toluene to obtain a toluene solution, 2.8 parts of the conductive particles (carbon black, REGAL 330 manufactured by Cabot Corporation) is further added to the toluene solution, and stirred for 5 minutes using a homogenizer, and a coating resin solution is prepared. The coating resin solution and 1,000 parts of the core particles (EF-35B manufactured by Powdertech Co., Ltd.) are put in a vacuum degassing type kneader, stirred for 20 minutes at 90° C., removed toluene under the reduced pressure, the cooling and stirring are performed until the temperature of the material reaches 60° C., the coated carrier is taken out and sieved with sieving mesh of 75 μm, and a carrier 8 is obtained.

Preparation of Carrier 9

A carrier 9 is obtained in the same manner as in the carrier 1, except for changing the resin particles C1 to resin particles C2 and the amount thereof to 16.1 parts and changing the resin particles A1 to the resin particles A2 and the amount thereof to 16.1 parts.

Preparation of Carrier 10

A carrier 10 is obtained in the same manner as in the carrier 1, except for changing the resin particles C1 to resin particles C3 and the amount thereof to 16.1 parts and changing the resin particles A1 to the resin particles A3 and the amount thereof to 16.1 parts.

Preparation of Carrier 11

A carrier 11 is obtained in the same manner as in the carrier 1, except for changing the amount of the resin particles C1 to 1.0 part and changing the amount of the resin particles A1 to 31.2 parts.

Preparation of Carrier 12

A carrier 12 is obtained in the same manner as in the carrier 1, except for changing the amount of the resin particles C1 to 24.2 parts and changing the amount of the resin particles A1 to 8.0 parts.

Preparation of Carrier 13

A carrier 13 is obtained in the same manner as in the carrier 1, except for changing the resin particles C1 to the resin particles C4 and the amount thereof to 16.1 parts and changing the resin particles A1 to the resin particles A4 and the amount thereof to 16.1 parts.

Preparation of Carrier 14

A carrier 14 is obtained in the same manner as in the carrier 1, except for changing the resin particles C1 to the resin particles C5 and the amount thereof to 16.1 parts and changing the resin particles A1 to the resin particles A5 and the amount thereof to 16.1 parts.

Preparation of Carrier 15

A carrier 15 is obtained in the same manner as in the carrier 1, except for changing the resin particles C1 to the resin particles C6 and the amount thereof to 16.1 parts and changing the resin particles A1 to the resin particles A6 and the amount thereof to 16.1 parts.

Preparation of Carrier 16

A carrier 16 is obtained in the same manner as in the carrier 1, except for changing the resin particles C1 to the resin particles C7 and the amount thereof to 16.1 parts and changing the resin particles A1 to the resin particles A7 and the amount thereof to 16.1 parts.

Preparation of Carrier 17

A carrier 17 is obtained in the same manner as in the carrier 1, except for changing the resin particles C1 and the resin particles A1 to 32.2 parts of the resin particles CA1.

Preparation of Carrier 18

A carrier 18 is obtained in the same manner as in the carrier 4, except for changing the resin particles A1 to the resin particles A9.

Preparation of Carrier 19

A carrier 19 is obtained in the same manner as in the carrier 4, except for changing the resin particles C1 to the resin particles C9.

Preparation of Carrier 20

A carrier 20 is obtained in the same manner as in the carrier 4, except for changing the resin particles A1 to the resin particles A9 and changing the resin particles C1 to the resin particles C9.

Preparation of Carrier 21

A carrier 21 is obtained in the same manner as in the carrier 1, except for changing the resin particles C1 to resin particles C8 and amount thereof to 16.1 parts and changing the resin particles A1 to the resin particles A8 and the amount thereof to 16.1 parts.

Preparation of Carrier 22

A carrier 22 is obtained in the same manner as in the carrier 8, except for changing the resin solution c1 to the resin solution c2 and changing the resin solution a1 to the resin solution a2.

Preparation of Carrier 23

A carrier 23 is obtained in the same manner as in the carrier 1, except that only the resin particles A1 is used as the resin particles and the amount added thereof to 32.2 parts.

Preparation of Carrier 24

A carrier 24 is obtained in the same manner as in the carrier 1, except that only the resin particles C1 is used as the resin particles and the amount added thereof to 32.2 parts.

Preparation of Toner

Synthesis of Amorphous Polyester Resin

Synthesis of Amorphous Polyester Resin 1

2.2 mol ethylene oxide adduct of bisphenol A: 40 parts by mol 2.2 mol propylene oxide adduct of bisphenol A: 60 parts by mol Terephthalic acid: 47 parts by mol Fumaric acid: 40 parts by mol Dodecenyl succinic anhydride: 15 parts by mol Trimellitic anhydride: 3 parts by mol The monomer components described above excluding fumaric acid and trimellitic anhydride, and 0.25 parts of tin dioctanoate with respect to 100 parts of total monomer components described above are put in a reaction vessel including a stirrer, a thermometer, a capacitor, and a nitrogen gas introducing tube. Under the nitrogen gas flow, the mixture is subjected to a reaction at 235° C. for 6 hours and then the temperature is dropped to 200° C., and fumaric acid and trimellitic anhydride are added thereto and subjected to a reaction for 1 hour. The mixture is further heated to 220° C. over 4 hours, and is polymerized under the pressure of 10 kPa until a desired molecular weight is obtained, and a light yellow transparent amorphous polyester resin 1 is obtained.

Regarding the obtained amorphous polyester resin 1, the glass transition temperature Tg measured by DSC is 59° C., the weight-average molecular weight Mw measured by GPC is 25,000, the number-average molecular weight Mn is 7,000, a softening temperature measured by a flow tester is 107° C., and the acid value AV is 13 mgKOH/g.

Preparation of Amorphous Polyester Resin Dispersion 1

While maintaining a jacketed reaction vessel (BJ-30N manufactured by Tokyo Rikakikai Co., Ltd.) including a capacitor, a thermometer, a water dropping device, and an anchor blade in a water circulating constant temperature vessel at 40° C., a mixed solvent of 160 parts of ethyl acetate and 100 parts of isopropyl alcohol is put in the reaction vessel, 300 parts of the amorphous polyester resin 1 is put therein, the mixture is stirred by using a three-one motor at 150 rpm and is dissolved to obtain an oil phase. 14 parts of 10% aqueous ammonia solution is added dropwise for 5 minutes to the oil phase being stirred and mixed therewith for 10 minutes, and 900 parts of ion exchange water is further added dropwise to the mixture at a rate of 7 parts per minute to perform phase inversion, and an emulsified solution is obtained.

Immediately after that, 800 parts of the obtained emulsified solution and 700 parts of ion exchange water are put in an eggplant flask, and set in an evaporator (manufactured by Tokyo Rikakikai Co., Ltd.) including a vacuum control unit through a trap bump. The mixture is heated in a hot water bath at 60° C. while rotating the eggplant flask, the pressure is reduced to 7 kPa while paying attention to bumping, and the solvent is removed. The pressure is returned to the normal pressure when the solvent collection amount becomes 1,100 parts, the eggplant flask is cooled with water, and a dispersion is obtained. The obtained dispersion does not have an odor of the solvent. A volume average particle diameter D50 of the resin particles in this dispersion is 130 nm. After that, the ion exchange water is added thereto to adjust a solid content concentration to 20%, and this is set as an amorphous polyester resin dispersion 1.

Synthesis of Crystalline Polyester Resin

Synthesis of Crystalline Polyester Resin 1

1,10-dodecanedioic acid: 50 parts by mol 1,9-nonanediol: 50 parts by mol

The monomer components are put in a reaction vessel including a stirrer, a thermometer, a capacitor, and a nitrogen gas introducing tube, the atmosphere in the reaction vessel is substituted with dry nitrogen gas, and 0.25 parts of titanium tetrabutoxide (reagent) with respect to 100 parts of the monomer components is added thereto. Under the nitrogen gas flow, the mixture is stirred and subjected to a reaction at 170° C. for 3 hours, and is further heated to 210° C. over 1 hour, the pressure in the reaction vessel is reduced to 3 kPa, the mixture is stirred and subjected to a reaction under the reduced pressure for 13 hours, and a crystalline polyester resin 1 is obtained.

Regarding the obtained crystalline polyester resin 1, the melting temperature measured by DSC is 73.6° C., the weight-average molecular weight Mw measured by GPC is 25,000, the number-average molecular weight Mn is 10,500, and the acid value AV is 10.1 mgKOH/g.

Preparation of Crystalline Polyester Resin Dispersion 1

300 parts of the crystalline polyester resin, 160 parts of methylethyl ketone (solvent), and 100 parts of isopropyl alcohol (solvent) are put in a jacketed reaction vessel (BJ-30N manufactured by Tokyo Rikakikai Co., Ltd.) including a capacitor, a thermometer, a water dropping device, and an anchor blade, and the mixture is stirred and mixed at 100 rpm while maintaining the reaction vessel in a water circulating constant temperature vessel at 70° C. to dissolve the resin (solution preparation process).

After that, the rotation rate of stirring is set to 150 rpm, the temperature of the water circulating constant temperature vessel is set at 66° C., 17 parts of the 10% aqueous ammonia (reagent) is added dropwise thereto over 10 minutes, a total of 900 parts of ion exchange water kept warm at 66° C. is added dropwise thereto at a rate of 7 part/min to perform phase inversion, and an emulsified solution is obtained.

Immediately after that, 800 parts of the obtained emulsified solution and 700 parts of ion exchange water are put in an eggplant flask, and set in an evaporator (manufactured by Tokyo Rikakikai Co., Ltd.) including a vacuum control unit through a trap bump. The mixture is heated in a hot water bath at 60° C. while rotating the eggplant flask, the pressure is reduced to 7 kPa while paying attention to bumping, and the solvent is removed. The pressure is returned to the normal pressure when the solvent collection amount becomes 1,100 parts, the eggplant flask is cooled with water, and a dispersion is obtained. The obtained dispersion does not have an odor of the solvent. A volume average particle diameter D50 of the resin particles in this dispersion is 130 nm. After that, the ion exchange water is added thereto to adjust a solid content concentration to 20%, and this is set as a crystalline polyester resin dispersion 1.

Preparation of Colorant Dispersion

Preparation of Black Pigment Dispersion

Carbon black (REGAL 330 manufactured by Cabot Corporation): 250 parts

Anionic surfactant (NEOGEN SC manufactured by Dai-Ichi Kogyo Seiyaku Co., Ltd.): 33 parts (60% of active ingredient, 8% with respect to the colorant)

Ion exchange water: 750 parts 280 parts of ion exchange water and 33 parts of anionic surfactant are put in a stainless steel vessel having a size that a height of a liquid surface when all of the above components are put therein is approximately ⅓ of the height of the vessel, the surfactant is sufficiently dissolved, the solid solution pigments are all put therein, the resultant material is stirred using a stirrer until the pigments not wet yet disappears, and sufficiently defoamed. The remaining ion exchange water is added thereto after the defoaming, the obtained mixture is dispersed by using a homogenizer (ULTRA TURRAX T50 manufactured by IKA Japan, K.K.) with 5,000 rotations for 10 minutes, is stirred using the stirrer for 24 hours and defoamed. After the defoaming, the resultant material is dispersed again by using the homogenizer with 6,000 rotations for 10 minutes, is stirred using the stirrer for 24 hours and defoamed. Then, the dispersion is dispersed by using a high pressure impact type dispersing machine ULTIMIZER (HJP30006 manufactured by Sugino Machine, Ltd.) at pressure of 240 MPa. The dispersion is performed to be equivalent to 25 passes on the basis of the total introduction amount and processing capacity of the device. The obtained dispersion is left for 72 hours to remove precipitates, and ion exchange water is added thereto to adjust a solid content concentration to 15%. The volume average particle diameter D50 of particles in the black pigment dispersion is 135 nm.

Preparation of Release Agent Dispersion

Hydrocarbon wax (product name: FNP0080 manufactured by Nippon Seiro Co., Ltd., melting temperature=80° C.): 270 parts Anionic surfactant (NEOGEN RK manufactured by Dai-Ichi Kogyo Seiyaku Co., Ltd., active ingredient amount: 60%): 13.5 parts (3.0% of active ingredient with respect to the release agent)

Ion exchange water: 21.6 parts

After mixing the above components and dissolving the release agent by using a pressure discharge type homogenizer (GAULIN homogenizer manufactured by Gaulin, Inc.) at an internal liquid temperature of 120° C., dispersion process is performed at a dispersion pressure of 5 Mpa for 120 minutes and then at a dispersion pressure of 40 MPa for 360 minutes, the mixture is cooled, and a release agent dispersion 1 is obtained. The volume average particle diameter D50 of particles in the release agent dispersion is 225 nm. After that, ion exchange water is added thereto to adjust a solid content concentration to 20.0%.

Preparation of Aluminum Sulfate Aqueous Solution

Aluminum sulfate powder (manufactured by Asada Chemical INDUSTRY Co., Ltd.: 17% aluminum sulfate): 35 parts Ion exchange water: 1,965 parts The above components are put in a vessel, stirred and mixed at 30° C. until the precipitate is eliminated, and an aluminum sulfate aqueous solution is prepared.

Preparation of Toner

Preparation of Toner 1

Amorphous polyester resin dispersion 1: 700 parts

Crystalline polyester resin dispersion 1: 50 parts

Black pigment dispersion: 133 parts

Release agent dispersion: 100 parts

Ion exchange water: 350 parts

Anionic surfactant (DOWFAX2A1 manufactured by The Dow Chemical Company): 2.9 parts After putting the above components in a reaction vessel including a thermometer, a pH meter, and a stirrer, and adding 1.0% nitric acid at 25° C. to adjust pH to 3.0, 130 parts of the prepared aluminum sulfate aqueous solution is added thereto while performing dispersion using a homogenizer (ULTRA TURRAX T50 manufactured by IKA Japan, K. K.) at 5,000 rpm and dispersion is performed for 6 minutes.

After that, a stirrer and a mantle heater are installed in the reaction vessel, the temperature is raised at a rate of temperature rise of 0.2° C./min up to 40° C. and at a rate of temperature rise of 0.05° C./min after the temperature exceeds 40° C. while adjusting the rotation rate of the stirrer so that the slurry is sufficiently stirred, and a particle diameter is measured using MULTISIZER II (manufactured by Beckman Coulter, Inc., aperture size: 50 μm) for every 10 minutes. The temperature is kept when a volume average particle diameter is 5.0 μm, and 50 parts of the amorphous polyester resin dispersion 1 is put therein over 5 minutes.

After holding the resultant material for 30 minutes, pH is adjusted to 9.0 using 1% aqueous sodium hydroxide solution. After that, the resultant material is heated to 90° C. at the rate of temperature rise of 1° C./min while adjusting pH to 9.0 in the same manner as described above for every 5° C. rise in temperature, and the temperature is held at 98° C. When a particle shape and a surface property are observed with an optical microscope and a scanning electron microscope (FE-SEM), coalescence of the particles are confirmed when 10.0 hours has elapsed, and accordingly the vessel is cooled with cooling water to 30° C. over 5 minutes.

The cooled slurry passes through nylon mesh of a mesh size of 15 μm to remove coarse powder, and toner slurry which has passed through the mesh is filtrated using an aspirator under the reduced pressure. The toner remaining on filter paper is crushed with hand into pieces as small as possible, and put into the ion exchange water in an amount of 10 times the amount of the toner at 30° C. and stirred and mixed for 30 minutes. Next, the mixture is filtrated using an aspirator under the reduced pressure, the toner remaining on the filter paper is crushed with hand into pieces as small as possible, and put into the ion exchange water in an amount of 10 times the amount of the toner at 30° C. and stirred and mixed for 30 minutes. After that the mixture is filtrated again using an aspirator under the reduced pressure, and electrical conductivity of the filtrate is measured. This operation is repeated until the electrical conductivity of the filtrate becomes equal to or less than 10 μS/cm, and the toner is washed.

The washed toner is crushed into small pieces with a wet type and dry-type granulator (Comil), is subjected to vacuum drying in an oven at 35° C. for 36 hours, and toner base particles 1 are obtained.

The volume average particle diameter D50 of the obtained toner base particles 1 is 6.0 μm and the shape factor thereof is 127.

1 part of the external additive R972 (manufactured by Aerosil Nippon Co., Ltd., 16 nm) is added to 100 parts of the toner base particles 1, and mixed with a HENSCHEL mixer at a peripheral speed of 30 m/s for 3 minutes. Then, the obtained mixture is sieved using a sieving machine having a mesh of 45 μm, and a toner 1 is obtained.

Preparation of Toner 2

A toner 2 is prepared in the same manner as in the toner 1, except that the amount of amorphous polyester resin dispersion 1 is changed from 700 parts to 750 parts and the crystalline polyester resin dispersion 1 is not used.

Developer 221 parts of the carrier and 19 parts of the toner are put in a V-blender, rotated at 20 rotations/min for 15 minutes, and an electrostatic charge image developer shown in Table 1 is obtained.

Method of Evaluating Image

An image forming apparatus (remodeled APEOS PORT-II C4300 manufactured by Fuji Xerox Co., Ltd.) is filled with the obtained developer, continuous printing is repeated in the set environments of "temperature of 15° C. and humidity of 30%" and "temperature of 30° C. and humidity of 85%", and image quality scores (density/fogging/fine-line reproducibility) at an initial stage and a time-elapsed stage are compared.

Specifically, in the environments described above, an operation of creating a gradation chart is performed two times in the initial stage and after undergoing an elapsing process with 100,000 sheets of dummy charts, and images at that time are evaluated (high temperature→low temperature high temperature→low temperature environments).

The image quality scores (density/fogging/fine-line reproducibility) in the initial stage and the time-elapsed stage in each environment are evaluated. The evaluation criteria are as follows.

A: No difference in density/fogging/fine-line reproducibility is observed by comparing with an initial image.

B: Slight difference is observed by comparing with an initial image.

C: density of apart of an image is low and reproducibility thereof is poor by comparing with an initial image, but it is in an acceptable range.

D: density of apart of an image is low and reproducibility thereof is poor by comparing with an initial image.

E: density of entire image is remarkably low by comparing with an initial image.

Even in a case of the equivalent image quality score, "+" is used for superior score, as "A+". The acceptable score is from A to C.

Results are shown in Table 1.

TABLE 1

| | Carrier | | | | | | | | | | | | |
|---|---|---|---|---|---|---|---|---|---|---|---|---|---|
| | | Volume average particle diameter | Types of surfactant | | Amount of surfactant | | | | | | CA preparing | | Evaluation Image quality |
| | No. | (μm) | Cationic | Anionic | Total amount (wt %) | Cationic/anionic (content ratio) | Cationic (wt %) | Anionic (wt %) | Synthesis number of coating resin cationic | Synthesis number of coating resin Anionic | method | toner No. | score |
| Ex. 1 | 1 | 36.2 | Stearyl trimethyl ammonium chloride | NEOGEN SC | 0.6 | 5/95 | 0.03 | 0.57 | Resin particles C1 | Resin particles A1 | Dry method | 1 | A |
| Ex. 2 | 2 | 36.4 | Stearyl trimethyl ammonium chloride | NEOGEN SC | 0.6 | 10/90 | 0.06 | 0.54 | Resin particles C1 | Resin particles A1 | Dry method | 1 | A |
| Ex. 3 | 3 | 36.3 | Stearyl trimethyl ammonium chloride | NEOGEN SC | 0.6 | 20/80 | 0.12 | 0.48 | Resin particles C1 | Resin particles A1 | Dry method | 1 | A |
| Ex. 4 | 4 | 36.7 | Stearyl trimethyl ammonium chloride | NEOGEN SC | 0.6 | 30/70 | 0.18 | 0.42 | Resin particles C1 | Resin particles A1 | Dry method | 1 | A+ |
| Ex. 5 | 5 | 36.4 | Stearyl trimethyl ammonium chloride | NEOGEN SC | 0.6 | 50/50 | 0.3 | 0.3 | Resin particles C1 | Resin particles A1 | Dry method | 1 | A |
| Ex. 6 | 6 | 36.5 | Stearyl trimethyl ammonium chloride | NEOGEN SC | 0.6 | 60/40 | 0.36 | 0.24 | Resin particles C1 | Resin particles A1 | Dry method | 1 | A |
| Ex. 7 | 7 | 36.2 | Stearyl trimethyl ammonium chloride | NEOGEN SC | 0.6 | 70/30 | 0.42 | 0.18 | Resin particles C1 | Resin particles A1 | Dry method | 1 | A |
| Ex. 8 | 8 | 36.2 | Stearyl trimethyl ammonium chloride | NEOGEN SC | 0.1 | 30/70 | 0.03 | 0.07 | Resin solution c1 | Resin solution a1 | Wet method | 1 | C |
| Ex. 9 | 9 | 36.4 | Stearyl trimethyl ammonium chloride | NEOGEN SC | 4 | 30/70 | 1.2 | 2.8 | Resin particles C2 | Resin particles A2 | Dry method | 1 | C |
| Ex. 10 | 10 | 36.5 | Stearyl trimethyl ammonium chloride | NEOGEN SC | 6 | 30/70 | 1.8 | 4.2 | Resin particles C3 | Resin particles A3 | Dry method | 1 | C |
| Ex. 11 | 11 | 36.3 | Stearyl trimethyl ammonium chloride | NEOGEN SC | 0.6 | 3/97 | 0.018 | 0.582 | Resin particles C1 | Resin particles A1 | Wet method | 1 | A− |

TABLE 1-continued

| | Carrier | | | | | | | | | | | | |
|---|---|---|---|---|---|---|---|---|---|---|---|---|---|
| | | Volume average particle diameter | Types of surfactant | | Amount of surfactant | | | | Synthesis number of coating resin | | CA preparing | | Evaluation Image quality |
| | No. | (μm) | Cationic | Anionic | Total amount (wt %) | Cationic/anionic (content ratio) | Cationic (wt %) | Anionic (wt %) | cationic | Anionic | method | toner No. | score |
| Ex. 12 | 12 | 36.5 | Stearyl trimethyl ammonium chloride | NEOGEN SC | 0.6 | 75/25 | 0.45 | 0.15 | Resin particles C1 | Resin particles A1 | Dry method | 1 | A− |
| Ex. 13 | 13 | 36.2 | Stearyl trimethyl ammonium chloride | NEOGEN SC | 0.3 | 30/70 | 0.09 | 0.21 | Resin particles C4 | Resin particles A4 | Dry method | 1 | B |
| Ex. 14 | 14 | 36.4 | Stearyl trimethyl ammonium chloride | NEOGEN SC | 2 | 30/70 | 0.6 | 1.4 | Resin particles C5 | Resin particles A5 | Dry method | 1 | B |
| Ex. 15 | 15 | 36.7 | Stearyl trimethyl ammonium chloride | NEOGEN SC | 0.4 | 30/70 | 0.12 | 0.28 | Resin particles C6 | Resin particles A6 | Dry method | 1 | A+ |
| Ex. 16 | 16 | 36.3 | Stearyi trimethyl ammonium chloride | NEOGEN SC | 1 | 30/70 | 0.3 | 0.7 | Resin particles C7 | Resin particles A7 | Dry method | 1 | A+ |
| Ex. 17 | 4 | 36.5 | Stearyl trimethyl ammonium chloride | NEOGEN SC | 0.6 | 30/70 | 0.18 | 0.42 | Resin particles C1 | Resin particles A1 | Dry method | 2 | A− |
| Ex. 18 | 17 | 36.6 | Stearyl trimethyl ammonium chloride | NEOGEN SC | 0.6 | 30/70 | 0.18 | 0.42 | Resin particles CA1 | | Dry method | 1 | A+ |
| Ex. 19 | 18 | 36.4 | Stearyl trimethyl ammonium chloride | Dowfax | 0.6 | 30/70 | 0.18 | 0.42 | Resin particles C1 | Resin particles A9 | Dry method | 1 | A+ |
| Ex. 20 | 19 | 36.2 | Alkyl benzyl dimethyl ammonium chloride | NEOGEN SC | 0.6 | 30/70 | 0.18 | 0.42 | Resin particles C9 | Resin particles A1 | Dry method | 1 | A+ |
| Ex. 21 | 20 | 36.4 | Alkyl benzyl dimethyl ammonium chloride | Dowfax | 0.6 | 30/70 | 0.18 | 0.42 | Resin particles C9 | Resin particles A9 | Dry method | 1 | A+ |
| Com. Ex. 1 | 21 | 36.7 | Stearyl trimethyl ammonium chloride | NEOGEN SC | 7 | 30/70 | 2.1 | 4.9 | Resin particles C8 | Resin particles A8 | Dry method | 1 | D |
| Com. Ex. 2 | 22 | 36.5 | Stearyl trimethyl ammonium chloride | NEOGEN SC | 0.05 | 30/70 | 0.015 | 0.035 | Resin solution c2 | Resin solution a2 | Wet method | 1 | D |
| Com. Ex. 3 | 23 | 36.3 | — | NEOGEN SC | 0.6 | 0/100 | 0 | 0.6 | — | Resin particles A1 | Dry method | 1 | D |
| Com. Ex. 4 | 24 | 36.5 | Stearyl trimethyl ammonium chloride | — | 0.6 | 100/0 | 0.6 | 0 | Resin particles C1 | — | Dry method | 1 | E |

In Examples 1 to 21, high image quality scores are obtained by employing a configuration of using the cationic surfactant and the anionic surfactant in combination and setting the total content of the surfactants to 0.1% by weight to 6.0% by weight of the entire resin coating layer, compared to a configuration of not setting the total content of the cationic surfactant and the anionic surfactant to 0.1% by weight to 6.0% by weight as in Comparative Examples 1 and 2 or not using the cationic surfactant and the anionic surfactant in combination as in Comparative Examples 3 and 4.

Higher image quality scores are obtained by employing a configuration where 30% by weight to 95% by weight of the total content of the surfactants is the anionic surfactant as in Examples 1 to 7, compared to a configuration where the content of the anionic surfactant is not 30% by weight to 95% by weight of the total content of the surfactants as in Examples 11 and 12.

Higher image quality scores are obtained by employing a configuration of using the developer formed of the toner including the crystalline resin and the carrier of the exemplary embodiment as in Example 4, compared to a configuration of not using the crystalline resin as in Example 17.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

a core particle; and a resin coating layer coated on the core particle, wherein:

the resin coating layer contains a cationic surfactant and an anionic surfactant, a total content of the cationic surfactant and the anionic surfactant in the resin coating layer is from 0.3% by weight to 2.0% by weight with respect to the entire resin coating layer, the cationic surfactant contains stearyl trimethyl ammonium chloride, and the anionic surfactant contains sodium dodecylbenzene sulfonate.

2. The electrostatic charge image developing carrier according to claim 1, wherein a content of the anionic surfactant is from 30% by weight to 95% by weight with respect to the total content of the cationic surfactant and the anionic surfactant contained in the resin coating layer.

3. The electrostatic charge image developing carrier according to claim 1, wherein the resin coating layer is a homopolymer or a copolymer of cycloalkyl methacrylate.

4. The electrostatic charge image developing carrier according to claim 1, wherein a content of the resin coating layer is from 0.1 parts by weight to 20 parts by weight with respect to 100 parts by weight of the core particle.

5. The electrostatic charge image developing carrier according to claim 1, wherein the coverage of the surface of the core particle with the resin coating layer is from 80% to 100%.

6. The electrostatic charge image developing carrier according to claim 1, wherein the volume electric resistance of the carrier is from $1\times10^{7}$ Ω·cm to $1\times10^{15}$ Ω·cm.

7. An electrostatic charge image developer comprising:

the electrostatic charge image developing carrier according to claim 1; and an electrostatic charge image developing toner.

8. The electrostatic charge image developer according to claim 7, wherein the electrostatic charge image developing toner contains a crystalline resin.

9. A developer cartridge comprising a container that accommodates the electrostatic charge image developer according to claim 7.

10. The electrostatic charge image developing carrier according to claim 1, wherein a total content of the cationic surfactant and the anionic surfactant in the resin coating layer is from 0.4% by weight to 1.0% by weight with respect to the entire resin coating layer.

* * * * *